United States Patent [19]

Bahov et al.

[11] Patent Number: 4,680,833

[45] Date of Patent: Jul. 21, 1987

[54] DRAWING APPARATUS

[75] Inventors: Dinko A. Bahov, Gabrovo; Hristo A. Bahov, Stara Zagora, both of Bulgaria

[73] Assignee: NPK "Textiling Maschinostroene", Gabrovo, Bulgaria

[21] Appl. No.: 861,497

[22] Filed: May 9, 1986

[51] Int. Cl.[4] ..... D01H 5/86

[52] U.S. Cl. ..... 19/244; 19/248

[58] Field of Search ..... 19/244, 249, 250, 260, 19/248, 236

[56] References Cited

U.S. PATENT DOCUMENTS

| | | | |
|---|---|---|---|
| 2,794,214 | 6/1957 | Sandelin | 19/248 |
| 3,479,700 | 11/1969 | Livingston | 19/260 |
| 4,387,487 | 6/1983 | Nakahara et al. | 19/249 |
| 4,525,897 | 7/1985 | Schulz et al. | 19/260 |

*Primary Examiner*—Louis K. Rimrodt

*Attorney, Agent, or Firm*—Karl F. Ross; Herbert Dubno

[57] ABSTRACT

A drafting apparatus for roving or sliver, designed for high speed pneumatic spinning machines. The drafting apparatus comprises inlet and outlet drawing pairs of rollers as well as pair of endless aprons. The upper drawing roller of the outgoing drawing pair of rollers is offset angularly about the axis of the lower drawing roller, towards the closest pair of endless aprons. The angle of offset of the upper drawing roller is from 15° up to 65°. The advantage of the drawing apparatus according to the invention is that impairment of the roving by the air flow around the outgoing pair of drawing rollers is avoided because of the offset of the upper drawing roller about the axis of the lower drawing roller towards the drawing aprons.

2 Claims, 1 Drawing Figure

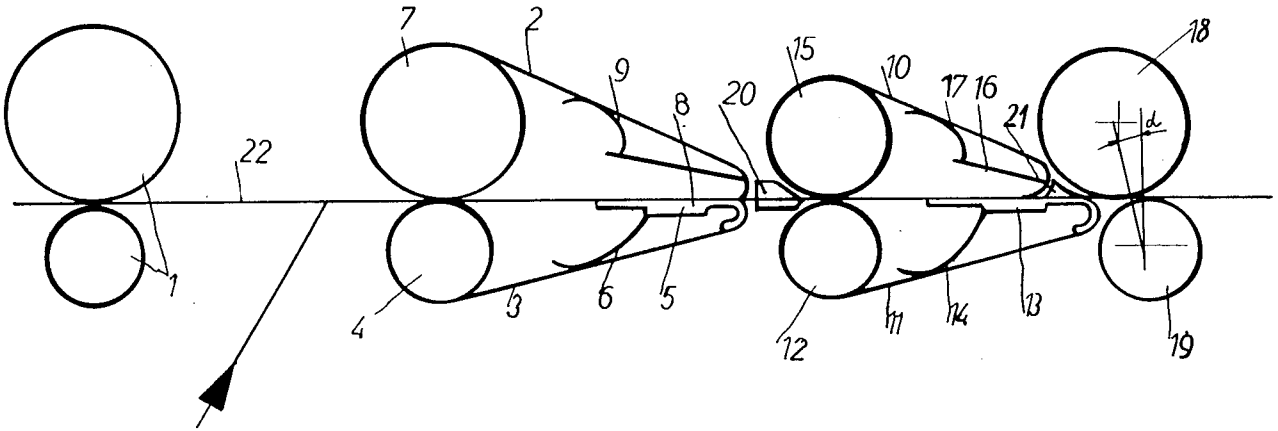
18
19
21
16
17
13
14
10
11
15
12
20
8
5
9
6
2
3
7
4
22
1

DRAWING APPARATUS

FIELD OF THE INVENTION

The present invention relates to a drafting apparatus for the drawing of fibrous ribbon or sliver, designed for high speed pneumatic spinning machines.

BACKGROUND OF THE INVENTION

A drafting apparatus is well known for drawing sliver or a roving (see U.S. Pat. No. 4,387,487) which comprises an inlet and an outlet pair of drawing rollers between which is located a double apron drafting pair, a front end of which is raised to a given height above the drawing line towards the peripheral surface of the upper drawing roller of the outlet pair of drawing rollers.

A disadvantage of this drafting apparatus is that the air flow round the lower drawing roller has an influence upon the motion of the roving being drawn, thus disturbing the straight and parallel position of the fibres.

OBJECT OF THE INVENTION

The object of the present invention is to provide a drafting apparatus which avoids the disturbing action of the air flow around the outgoing pair of drafting rollers on the rowing.

SUMMARY OF THE INVENTION

This object is attained in a drafting apparatus which comprises inlet and outlet pairs of drafting rollers, as well as endless aprons. According to the invention the upper drafting roller of the outlet pair of drafting rollers is shifted towards the axis of the lower drawing roller towards the pair of endless aprons located in proximity to this outlet pair of drafting rollers.

The drafting apparatus according to the invention, eliminates any impairment of the roving by the air flow round the outgoing pair of drafting rollers, because the upper drawing roller is rotates around the axis of the lower drawing roller towards the drafting aprons.

BRIEF DESCRIPTION OF THE DRAWING

The invention is explained in detail with reference to the sole FIGURE of the drawing which is a diagrammatic side elevational view illustrating the invention.

The drafting apparatus according to the invention, comprises an inlet drafting pair 1 of rollers followed by a first pair of endless aprons 2,3. The lower endless apron 3 passes around a lower drafting roller 4, is guided at its front end by a T-shaped plate 5 and is held taut by leaf spring 6. The upper endless apron 2 passes around the upper drawing roller 7, is guided by a plate 8, and is held taut by leaf spring 9.

Downstream of the first pair of endless drafting aprons 2, 3 is located the second pair of endless drafting aprons 10, 11. The lower endless apron 11 passes around the lower drafting roller 12, is guided at its front end by T-shaped plate 13, and is held taut by leaf spring 17. Downstream of the second drawing pair of endless aprons 10, 11, is mounted an outgoing or discharge drafting pair of rollers 18, 19. The axis of the upper drawing roller 18 can be swung around the axis of the lower drawing roller 19 towards the second pair of endless aprons 10, 11 through an angle $\alpha$, which varies from 15° up to 65°, so that the front ends of the second drawing pair of endless aprons 10, 11 are near to the outgoing drawing pair of rollers 18, 19. Ahead of the second pair of endless drafting aprons 10, 11 and ahead of the outgoing pair of drafting rollers 19, 19 are placed the gaskets 20, 21.

Roving 22 is fed from the inlet drawing pair of rollers 1, towards the first pair of endless drafting aprons 2, 3, which controls the motion of the fibers during their first drawing phase by the second pair of endless drafting aprons 10, 11 these, on their part, control the the movement of the fibers during a second drawing by the outgoing drafting rollers 18, 19. As a result of the excellent control of the fibers in the first zone between the inlet drawing pair of rollers 1 and the second drafting pair of endless aprons 10, 11, a higher degree of drawing may be achieved because of the proximity of the lower second drawing endless apron 11 to the surface of the outgoing drawing roller 19, while the upper second drawing endless apron 10 is near the surface of the outgoing drawing roller 18, any impairment of the air flows is eliminated. Thus the fibrous ribbon 22 is enveloped by the surface of the outgoing drawing roller 18, keeping the parallel position of the fibres.

We claim:

1. A roving and sliver drafting apparatus, comprising:

a pair of input drafting rollers receiving a roving to be drawn between them;

a first pair of drafting aprons each comprising an endless band passing over a respective roller disposed downstream of said input drafting rollers and receiving said roving from said input drafting rollers;

a further pair of drafting aprons each comprising an endless band passing over a respective roller disposed downstream of said first pair of drafting aprons and receiving said roving from said first pair of drafting rollers, said bands of said further pair of drafting rollers forming an upper and a lower band having downstream ends at which said roving emerges; and a pair of output drafting rollers downstream of said further pair of drafting aprons and receiving the roving emerging from said downstream end, said pair of output drafting rollers including a lower drafting roller having an axis, and an upper drafting roller having an axis, said axis of said upper drafting roller being offset angularly about said axis of said lower roller toward said further pair of drafting aprons from a position in which said axes are coplanar and lie in a plane perpendicular to a drafting plane defined by said pair of input drafting rollers and said pairs of drafting aprons to cause said upper drafting roller to overhang said downstream end of said lower band.

2. The roving and sliver drafting apparatus defined in claim 1 wherein said axis of said upper drafting roller of said pair of output drafting rollers defines a plane with the axis of the lower roller of the latter pair which includes an angle of 15° to 65° with said plane perpendicular to said drafting plane.

* * * * *

UNITED STATES PATENT AND TRADEMARK OFFICE

CERTIFICATE OF CORRECTION

PATENT NO. : 4,680,833

DATED : 21 July 1987

INVENTOR(S) : Dinko Atanassov BAHOV et al

It is certified that error appears in the above-identified patent and that said Letters Patent is hereby corrected as shown below:

ON THE TITLE PAGE ASSIGNEE SHOULD READ,

-- NPK "TEXTILNO MASCHINOSTROENE". --.

Signed and Sealed this

Sixteenth Day of February, 1988

*Attest:*

*Attesting Officer*

DONALD J. QUIGG

*Commissioner of Patents and Trademarks*